United States Patent [19]

Gantner

[11] Patent Number: 5,025,870

[45] Date of Patent: Jun. 25, 1991

[54] HAND-HELD TOOL WITH DISPLACEABLE SPRING LOADED HANDLE

[75] Inventor: Gebhard Gantner, Nenzing, Austria

[73] Assignee: Hilti Aktiengesellschaft, Liechtenstein

[21] Appl. No.: 439,263

[22] Filed: Nov. 20, 1989

[30] Foreign Application Priority Data

Nov. 19, 1988 [DE] Fed. Rep. of Germany ..... 3839207

[51] Int. Cl.[5] ..... B25D 17/04

[52] U.S. Cl. ..... 173/162.2; 173/162.1

[58] Field of Search ..... 173/162.1, 162.2; 16/116 R; 81/177.1, 177.7, 177.8

[56] References Cited

U.S. PATENT DOCUMENTS

| | | | |
|---|---|---|---|
| 4,282,938 | 8/1981 | Minamidate | 173/162.2 |
| 4,711,308 | 12/1987 | Blaas et al. | 173/162.2 |
| 4,800,965 | 1/1989 | Keller | 173/162.2 |

FOREIGN PATENT DOCUMENTS

| | | | |
|---|---|---|---|
| 46702 | 2/1967 | U.S.S.R. | 173/162.2 |
| 457594 | 1/1975 | U.S.S.R. | 173/162.2 |

*Primary Examiner*—Howard N. Goldberg
*Assistant Examiner*—Willmon Fridie, Jr.
*Attorney, Agent, or Firm*—Toren, McGeady & Associates

[57] ABSTRACT

A portable hand-held tool, such as a hammer drill or chisel hammer, includes a housing having a main vibration axis and a handle displaceably secured to the housing and movable toward the housing against compression springs. The springs have an axis of compression disposed at an angle to the main vibration axis. When the handle is displaced toward the housing, the spring is compressed. At the same time, however, the increased force of the spring is compensated by the increase in the angle of the spring relative to the main vibration axis. As a result, though the spring force increases, its component acting in the main vibration axis direction is reduced, and the spring force acting in the main vibration axis direction remains constant.

7 Claims, 3 Drawing Sheets

HAND-HELD TOOL WITH DISPLACEABLE SPRING LOADED HANDLE

BACKGROUND OF THE INVENTION

The present invention is directed to a portable hand-held device, such as a hammer drill or chisel hammer, comprising a housing containing a striking mechanism acting in a main vibration axis direction of the housing against a tool or bit. A handle is displaceably connected to the housing for movement substantially in the direction of the main vibration axis against the force of a compression spring.

In such hand-held tools, vibrations develop in the housing during the striking action produced by the striking mechanism. These vibrations are transmitted to the arms of the tool user through the handle. Such vibrations not only cause fatigue, but are also damaging to the user's health, particularly to his joints.

Various attempts have been made using springs, rubber elements, and the like to insulate the handle of the housing against vibrations. As an example, DE-PS 2 204 160 discloses a chisel hammer in which the handle is supported on the housing by a compression spring extending in the active direction of the tool. This solution has the disadvantage that the required force for displacing the handle along the active direction is not constant and the vibration insulation is insufficient.

SUMMARY OF THE INVENTION

The primary object of the present invention is to provide a portable hand-held tool incorporating a simple, robust, and effective vibration insulation.

In accordance with the present invention, the vibration insulation is provided by a compression spring mounted in the tool and inclined relative to the main vibration axis direction.

Due to the inclined arrangement of the compression spring, only one component of the spring force acts in the drilling or working direction, that is, in the main vibration axis direction. The value of the component depends on the angle of inclination between the axis of the compression spring and the working direction. This angle changes when the handle is displaced toward the housing. In addition, the force of the compression spring changes during displacement of the handle. As a result, while the force of the compression spring increases as the handle is displaced in the working direction, the component of the force, acting in the working direction, is reduced. These two factors of the spring force compensate one another whereby, considered as a whole, the force acting in the main vibration axis direction remains constant.

The angle of inclination between the axis of the compression spring and the main vibration axis direction is preferably in the range of 45° to 75°. At an average angle of 60°, the component acting in the direction of the main vibration axis is about half of the spring force. Moreover, the angle of inclination of the compression spring is still sufficiently great, so that deflection of the compression spring and, accordingly, an increase in the spring force is effected during the displacement of the handle toward the housing. Preferably, the compression spring is pretensioned, and stops for maintaining the pretensioning force are provided on the housing and the handle. The spring force, along with the force required for displacement of the handle, can be optimized by the pretensioning of the compression spring. The stops on the housing and on the handle define the initial position of the handle, that is, the rest position.

Advantageously, an adjusting device is provided for adjusting the pretensioning force. A screw can be utilized as the adjusting device. A screw is adjustable in a simple manner using conventional tools. If necessary, the pretensioning force can be adapted to and optimized for the work position of the device, that is, for drilling in a downward, upward or horizontal direction.

In a preferred construction, the compression spring is located between the housing and the handle, with the handle connected to the housing by at least two swivel arms rotatably supported on the housing and on the handle with the swivel arms disposed in spaced relation. In combination with the housing and the handle, the swivel arms form a parallelogram, whereby the handle is displaced approximately in a parallel manner. Friction can be kept very small by a suitable support of the swivel arms.

Therefore, relatively small forces are also possible for the compression spring.

In another preferred embodiment, the pressure spring is located between the handle and the handle and the housing is connected with the housing by a swivel joint. Accordingly, the handle is rotatable about the joint. As a result, the handle can swivel about the joint relative to the housing. With this arrangement, the portion of the vibrations transmitted through the handle to the swivel joint remain relatively small, because of a sufficiently large distance of the point of application of the hand force from the swivel joint, that is, by means of a sufficiently large pivoting radius. This solution is particularly simple.

In still another embodiment, the compression spring is positioned between the housing and the handle with the handle connected to the housing so it can be displaced along rectilinear guides. Such rectilinear guides can be guide rods slidably displaceable in bushings. Rolling guides, distinguished by particularly low friction, can also be used for higher requirements.

A plurality of compression springs, inclined relative to the main vibration axis direction and disposed substantially parallel to one another, afford an advantageous arrangement. The individual springs can be dimensioned smaller by distributing the entire spring force over a plurality of springs, and a more compact construction can be achieved. The lateral forces can be compensated and one-sided loading of the handle can be prevented by using a symmetrical arrangement of the compression springs on both sides of the striking mechanism.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
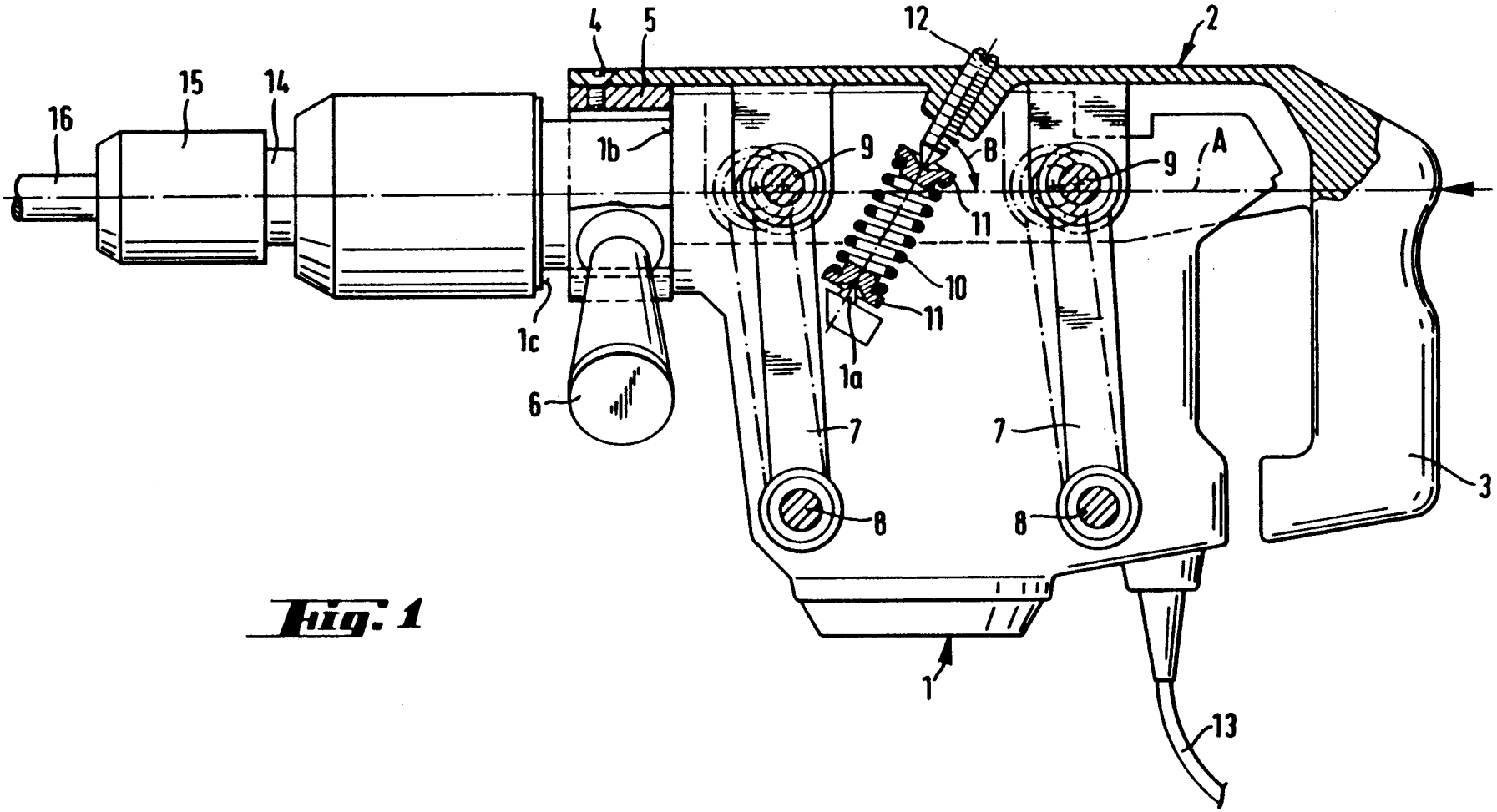
FIG. 1 is a side elevational view, partly in section, of a first embodiment of a hand-held tool, incorporating the present invention, with a handle connected to a housing via swivel arms.

In FIG. 1 a hand-held tool is shown, including a housing 1 having a first end on the left and a second end on the right, with a carrier 2 connected to the housing between the ends. The carrier 2 is movably displaceable relative to the housing 1. At the second end of the housing 1, a handle 3 is connected to the carrier 2. At the opposite end of the carrier 2 from the handle 3, a ring 5 is connected with the carrier by screws 4. A side grip 6 is fixed to the ring 5 and extends radially outwardly from the ring. As can be seen in FIG. 1, ring 5 has radial play relative to the housing 1. Carrier 2 is connected to the housing 1 by swivel arms 7 disposed in parallel spaced relation with the arms arranged to rotate. Swivel arms 7 are connected to the housing 1 by axles 8 and are connected to the carrier 2 by pins 9. Compression springs 10, located between the arms, extend between the housing 1 and the carrier 2. The pressure springs are inclined relative to the direction of the main vibration axis A at an angle B of approximately 60°. The opposite ends of the compression springs 10 are provided with guide parts 11. A support bearing 1*a* on the housing 1 provides support for one end of the compression spring 10, while a threaded pin 12 extending through the carrier 2 bears against the guide part 11 at the other end of the compression spring. A pivotal movement of the compression spring 10 is effected during displacement of the carrier 2 relative to the housing 1 and, as a result, the compression spring 10 is compressed and the spring force is increased. During such displacement of the carrier toward the first end of the housing, the angle B is increased as the arms 7 swivel or pivot into the position shown in dot-dash lines. Due to its inclined position, only a component of the spring force acts in the direction of the main vibration axis, and when pivoted into the dot-dash position, the component acting in the direction of the axis A, decreases. These two force factors compensate for one another by a suitable agreement of the spring constant of the compression spring 10 and the angle B of inclination, so that, considered absolutely, the force acting in the main vibration axis direction remains constant. Such a force which remains constant, regardless of the displacement path, results in an optimum vibration insulation of the handle 3 attached to the carrier 2 and of the side grip 6 relative to the housing 1. Pretensioning of the compression spring 10 can be adjusted to a desired level by the threaded pin 12. A cable 13 is connected to the housing 1 for providing a power supply. The cable connection is located at the second end of the housing 1 adjacent to the handle 3. At its first end, a spindle 14 projects axially out of the housing 1 and is connected with a tool holder or chuck 15 for retaining a tool 16.

In the initial position, displayed in FIG. 1, the carrier 2 and the ring 5 connected to it are pressed against a stop 1*b* on the housing 1 by the compression spring 10. When the tool is pressed against a surface by means of the handle 3 and the side grip 6, carrier 2 is moved out of contact with the stop 1*b* and is pressed in the direction of the shoulder 1*c*. In addition to the displacement of the carrier in the direction of the main vibration axis A, a displacement also takes place transverse to the axis A, since the pins 9 securing the arms 7 to the carrier 2, move in a circular path around the axles 8 as the carrier 2 moves relative to the housing 1 toward its first end. This displacement of the carrier also effects a deformation or compression of the spring 10 with a resultant increase in the spring force.

Figure 2:
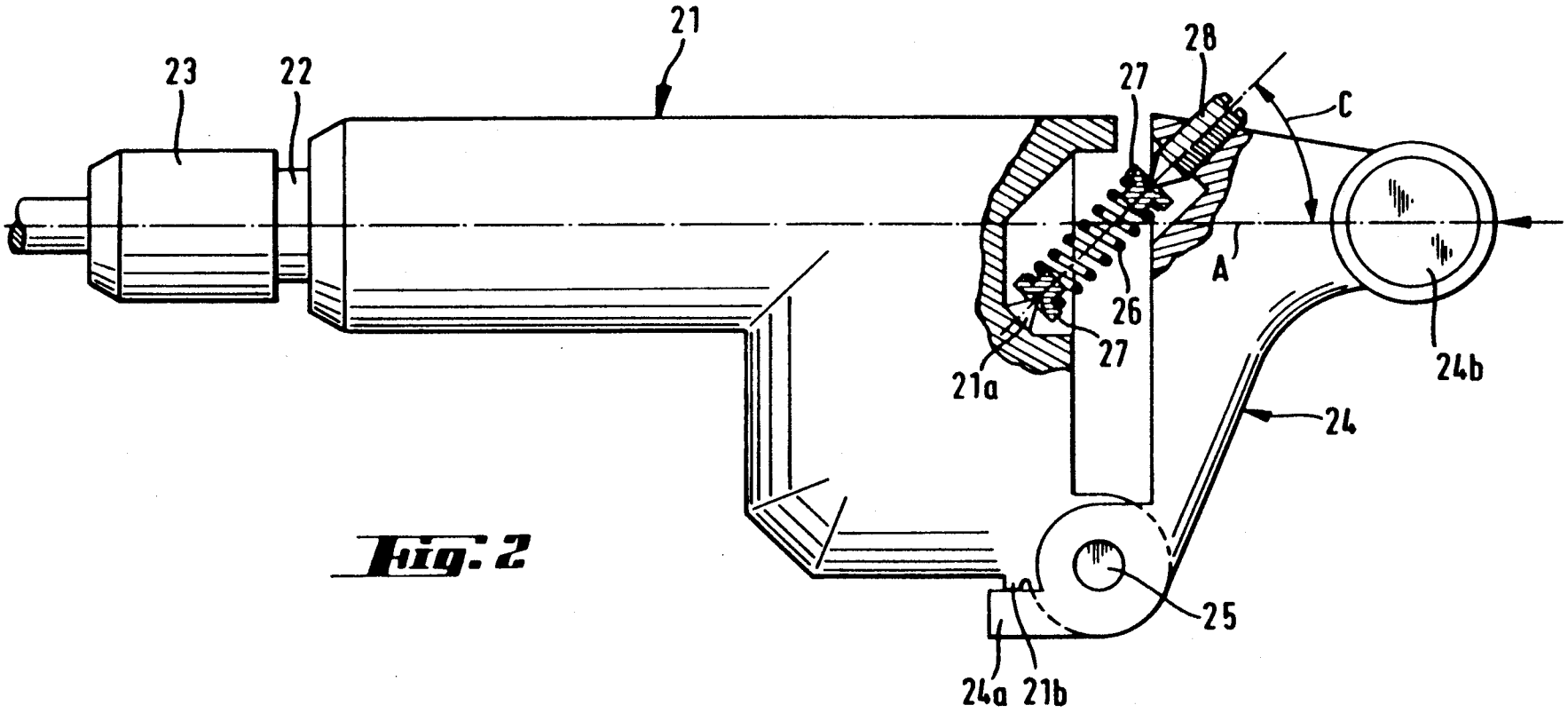
FIG. 2 is a view, similar to FIG. 1, of a second embodiment of a hand-held tool, embodying the present invention, and including a handle rotatably supported on the housing.

In FIG. 2, another hand-held tool is shown, including a housing 21 having a first end at the left and a second end at the right, as viewed in the Figure. At the first end, a tool holder 23 for holding a bit or working tool is located on a spindle 22 projecting axially from the first end of the housing 21. At the second end of the housing 21, a handle 24 is rotatably connected to it by a swivel joint 25. Compression spring 26 extends between the housing 21 and the handle 24. The compression spring 26 is disposed at an angle C, relative to the direction of the main vibration axis A of the tool. Due to its inclined arrangement, the spring force has two components with one component acting in the direction of the main vibration axis A. As the handle 24 pivots in the counterclockwise direction about the swivel joint 25, the force component, acting in the direction of the axis A, decreases. With the spring force being increased at the same time as it is compressed, the two different force factors compensate for one another, whereby the force acting absolutely in the direction of the main vibration axis A, remains approximately constant. Compression spring 26 extends between two guide parts 27, one supported at a bearing 21*a* on the housing 21 and the other at a screw 28, threaded into the handle 21. Compression spring 26 tends to rotate the handle 24 in the clockwise direction. Such movement is limited by a stop 21*b* on the housing 21 and a stop 24*a* on the handle 24. Handle 24 includes a known grip part 24*b* which extends in a T-shaped manner on both sides of the handle.

Figure 3:
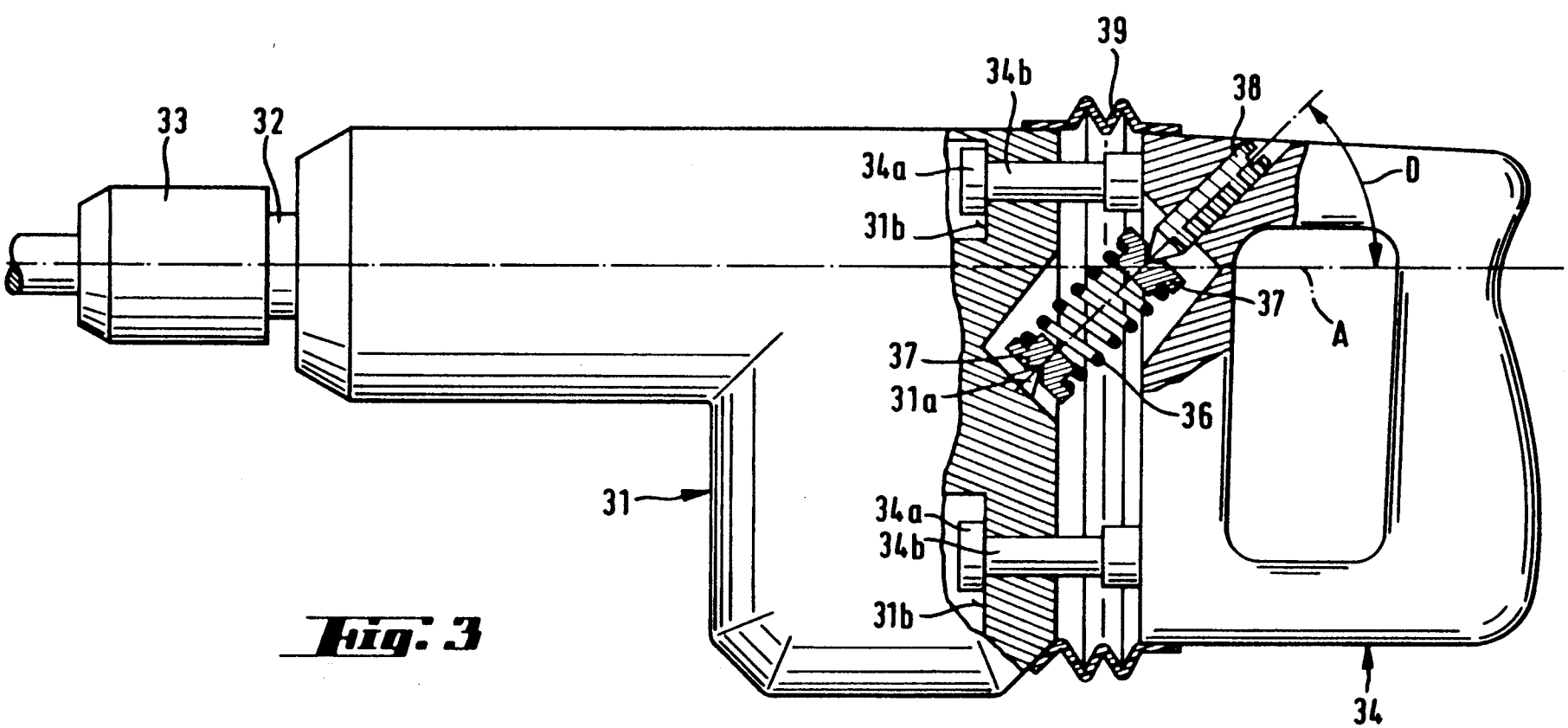
FIG. 3 is a view similar to FIGS. 1 and 2, displaying a third embodiment of the present invention with the handle linearly displaceably supported on the housing.

In the third embodiment of the present invention, set forth in FIG. 3, the hand-held tool includes a housing 31, having a first end at the left end of the Figure, and a second end at the right end. At the first end, a spindle 32 extends axially out of the housing 31 and is connected to a tool holder 33. At the second end of the housing 31, a handle 34 is positioned. Handle 34 is displaceable relative to the housing 31 in the direction of the main vibration axis A. The displacement of handle 34 is limited by stops 34*a* secured to the handle and by stops 31*b* formed on the housing. A compression spring 36 extends between the housing 31 and the handle 34. Spring 36 is positioned at an angle D relative to the direction of the main vibration axis A. Due to its inclined arrangement, only one force component of the spring 36 acts on the handle in the direction of the vibration axis. When the handle 34 is pressed toward the second end of the housing 31, the force component, acting in the direction of the vibration axis, decreases. Since the spring force of the compression spring 36 increases as a whole when the handle 34 is pressed toward the housing 31, these two different forces approximately balance one another, so that the force of the compression spring 36 opposing the displacement of the handle remains approximately constant in an absolute sense. Optimum vibration insulation is achieved between the housing 31 and the handle 34 by mean of the constant spring force. Compression spring 36 is compressed between two guide parts 37, one supported at a bearing 31*a* on the housing 31 and the other at a screw 36 threaded into the handle 34. Screw 36 permits an adjustment of the pretensioning of the compression spring 36. This pretensioning force can be optimized and, depending on the circumstances, can be adjusted according to the use position of the hand-held tool, that is, depending on whether the tool is being used in the downward, upward or horizontal direction. Guidance of the handle during rectilinear movement is afforded by the guide rods 34*b* mounted in the housing 31 and supporting the stops 34*a*. A bellows 39 is secured between the housing 31 and the handle 34 to prevent soiling of the guide rods 34 which would impair their sliding characteristics.

While specific embodiments of the invention have been shown and described in detail to illustrate the application of the inventive principles, it will be understood that the invention may be embodied otherwise without departing from such principles.

I claim:

1. Portable hand-held tool, such as a hammer drill or chisel hammer, comprises a housing having a main vibration axis and a first end and a second end spaced apart in the main vibration axis direction, means within said housing for producing a striking movement in the main vibration axis direction against a tool secured to the first end of said housing, a handle displaceably secured to the second end of said housing, a compression spring held in bearing contact with said housing and said handle, said handle being displaceable toward said housing against said compression spring, wherein the improvement comprises that said spring has a compression axis disposed at an angle to said main vibration axis and said angle increases when said handle is displaced toward said housing, and said compression spring is arranged at an angle relative to the main vibration axis of said housing in the range of 45° to 75°.

2. Portable hand-held tool, as set forth in claim 1, wherein pretensioning means are provided in contact with said compression spring for pretensioning said spring between stops on said housing and said handle for maintaining a pretensioning force on said spring.

3. Portable hand-held tool, as set forth in claim 2, wherein said pretensioning means comprises an adjusting device for adjusting the pretensioning force.

4. Portable hand-held tool, as set forth in claim 1, wherein said handle is connected to said housing by at least two swivel arms, with said arms disposed in spaced relation and being rotatable about said housing for displacing said handle relative to said housing.

5. Portable hand-held tool, as set forth in claim 1, wherein said handle is connected to said housing by a swivel joint.

6. Portable hand-held tool, as set forth in claim 1, wherein rectilinear guides are connected to said handle and are slidably displaceable in said housing for effecting displacement of said handle relative to said housing.

7. Portable hand-held tool, as set forth in claim 1, wherein a plurality of said compression springs are provided, each inclined relative to the direction of the main vibration axis and arranged in substantially parallel relation relative to one another.

* * * * *